US011280070B2

(12) United States Patent
Lee et al.

(10) Patent No.: US 11,280,070 B2
(45) Date of Patent: Mar. 22, 2022

(54) RETRACTABLE HOSE STRUCTURE OF PULL-OUT FAUCET

(71) Applicant: Ching Shenger Co., Ltd., Xianxi Township, Changhua County (TW)

(72) Inventors: Chin-Tsai Lee, Xianxi Township (TW); Ming-Che Lee, Xianxi Township (TW)

(73) Assignee: Ching Shenger Co., Ltd., Xianxi Township (TW)

( * ) Notice: Subject to any disclaimer, the term of this patent is extended or adjusted under 35 U.S.C. 154(b) by 49 days.

(21) Appl. No.: 16/892,485

(22) Filed: Jun. 4, 2020

(65) Prior Publication Data

US 2021/0381209 A1 Dec. 9, 2021

(51) Int. Cl.
*E03C 1/04* (2006.01)

(52) U.S. Cl.
CPC .... *E03C 1/0404* (2013.01); *E03C 2001/0415* (2013.01); *Y10T 137/9464* (2015.04)

(58) Field of Classification Search
CPC ..... E03C 1/0404; E03C 2001/0415; Y10T 137/9464
See application file for complete search history.

(56) References Cited

U.S. PATENT DOCUMENTS 8,899,259 B2 * 12/2014 Jonte ..... E03C 1/0402 137/315.12
2008/0196160 A1 * 8/2008 Alder ..... F16L 11/16 4/678
2009/0266433 A1 * 10/2009 Liang ..... E03C 1/0404 137/801
2016/0215482 A1 * 7/2016 Fourman ..... E03C 1/0404
2016/0312449 A1 * 10/2016 Kostorz ..... E03C 1/0404
2020/0123741 A1 * 4/2020 Huang ..... E03C 1/0404

FOREIGN PATENT DOCUMENTS

EP 1201836 A2 * 5/2002 ..... E03C 1/0404

OTHER PUBLICATIONS

Translation, May 2002, EP, Lutscher Michael.*

* cited by examiner

*Primary Examiner* — Jessica Cahill
*Assistant Examiner* — Patrick C Williams
(74) *Attorney, Agent, or Firm* — Karin L. Williams; Alan D. Kamrath; Mayer & Williams PC

(57) ABSTRACT

A retractable hose structure of a pull-out faucet contains: a body, a supply pipe, a flexible hose, and a spring. The body includes a locking portion. The supply pipe is hollow and includes a defining portion, an opening, and a screw element. The flexible hose is slidably received in the supply pipe and includes a slide portion and a water supply head. The water supply head is locked with the opening and is pulled outward with the flexible hose. The spring is accommodated in the supply pipe and is fitted on the flexible hose, and at least one non-metallic insulation layer is defined between the spring and the supply pipe. When pulling the water supply head outward, the spring is actuated by the flexible hose to retract. When releasing the water supply head, the spring drives the water supply head to move back to an original position.

10 Claims, 6 Drawing Sheets

RETRACTABLE HOSE STRUCTURE OF PULL-OUT FAUCET

BACKGROUND OF THE INVENTION

Field of the Invention

The present invention relates to a faucet, and more particularly to a retractable hose structure for a pull-out faucet.

Description of the Prior Art

Faucet is one of the indispensable water supply tools in human life, and a development of faucets has led to advancement to an application of washing. For example, a structure design of different faucets is gradually applied on a sink, a countertop, and washstand, thus providing consumers with more diversified appearances. With these faucets designed for special purposes, it is more convenient for people to use water.

Conventionally, the faucets installed on the countertop are designed in vertical type. For a convenience of water control, a water control valve is often designed to be located beside a body of a faucet, and a supply pipe is located on a top of the body. However, it is required to washing the countertop after using the countertop. When washing the countertop with the faucet, the supply pipe cannot be pulled to the countertop. To overcome this problem, a faucet with a flexible hose has been developed, wherein the flexible hose is received in the supply pipe, a first end of the flexible hose is inserted through the body to connect with a threaded tube of a water control valve, and a second end of the flexible hose is coupled with a water supply head, wherein the water supply head is fitted on an outer wall of the water supply pipe, such that when washing the countertop or other objects in a large size, the flexible hose is pulled to extend the water supply head to a desired position.

Nevertheless, the flexible hose is inserted through the body, so the water control valve, an inlet pipe, and the water supply pipe are accommodated in limited space so that the flexible hose is received in the body, and a counterweight is fixed on the flexible hose. When pulling the flexible hose downward by ways of the counterweight, a size of the body of the faucet is quite large, the space is limited, and the flexible hose is bendable, so the flexible hose is stopped by the water control valve, when inserting the flexible hose into the body from an end of the water supply pipe, thus causing difficult installation and obstructing the flexible hose in the body.

The present invention has arisen to mitigate and/or obviate the afore-described disadvantages.

SUMMARY OF THE INVENTION

The primary object of the present invention is to provide a retractable hose structure of a pull-out faucet which contains a flexible hose and a spring both accommodated in a supply pipe so as to reduce a size of a faucet and obtain easy fabrication.

Another objective of the present invention is to provide a retractable hose structure of a pull-out faucet which contains the flexible hose not passing through a body so as to achieve easy installation and maintenance.

To achieve above-mentioned objectives, a retractable hose structure of a pull-out faucet provided by the present invention contains: a body, a supply pipe, a flexible hose, and a spring.

The body includes a locking portion formed on a top thereof.

The supply pipe is hollow, and the supply pipe includes a defining portion formed on a first end of the supply pipe, an opening defined on a second end of the supply pipe, and a screw element locked on an outer wall of the defining portion. The defining portion is screwed with the locking portion of the body by the screw element.

The flexible hose is slidably received in the supply pipe, and the flexible hose includes a slide portion formed on a first end of the flexible hose, and a water supply head fixed on a second end of the flexible hose and located outside of the supply pipe. The water supply head is locked with the opening of the supply pipe and is pulled outward with the flexible hose based on using requirements.

The spring is accommodated in the supply pipe and is fitted on an outer wall of the flexible hose. At least one non-metallic insulation layer is defined between the spring and the supply pipe so as to stop the spring contacting with the supply pipe directly.

When pulling the water supply head outward, the spring is actuated by the flexible hose to retract. When releasing the water supply head, the spring drives the water supply head to move back to an original position.

DETAILED DESCRIPTION OF THE PREFERRED EMBODIMENTS

Figure 1:
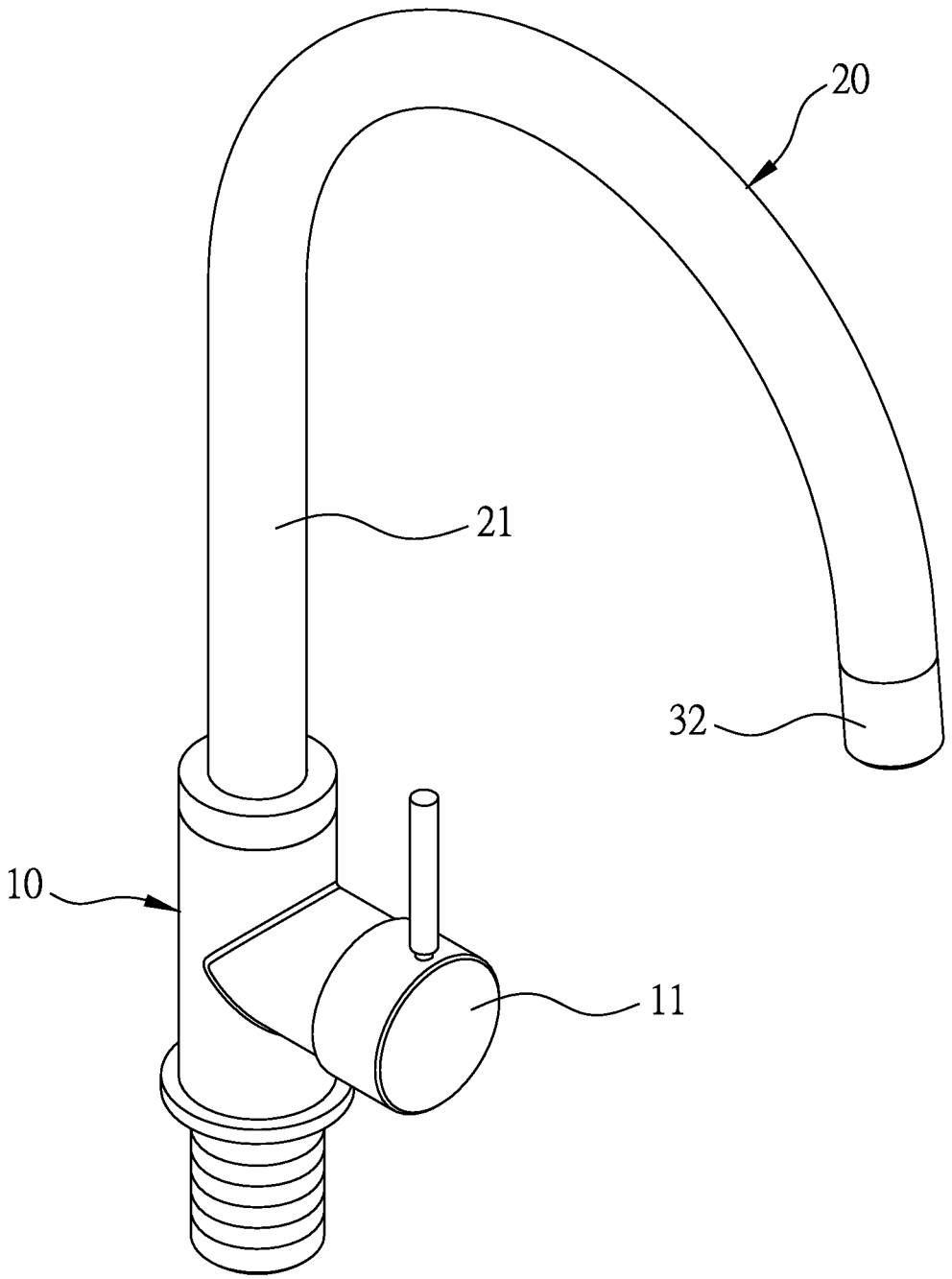
FIG. 1 is a perspective view showing the assembly of a retractable hose structure of a pull-out faucet according to a preferred embodiment of the present invention.
Figure 2:
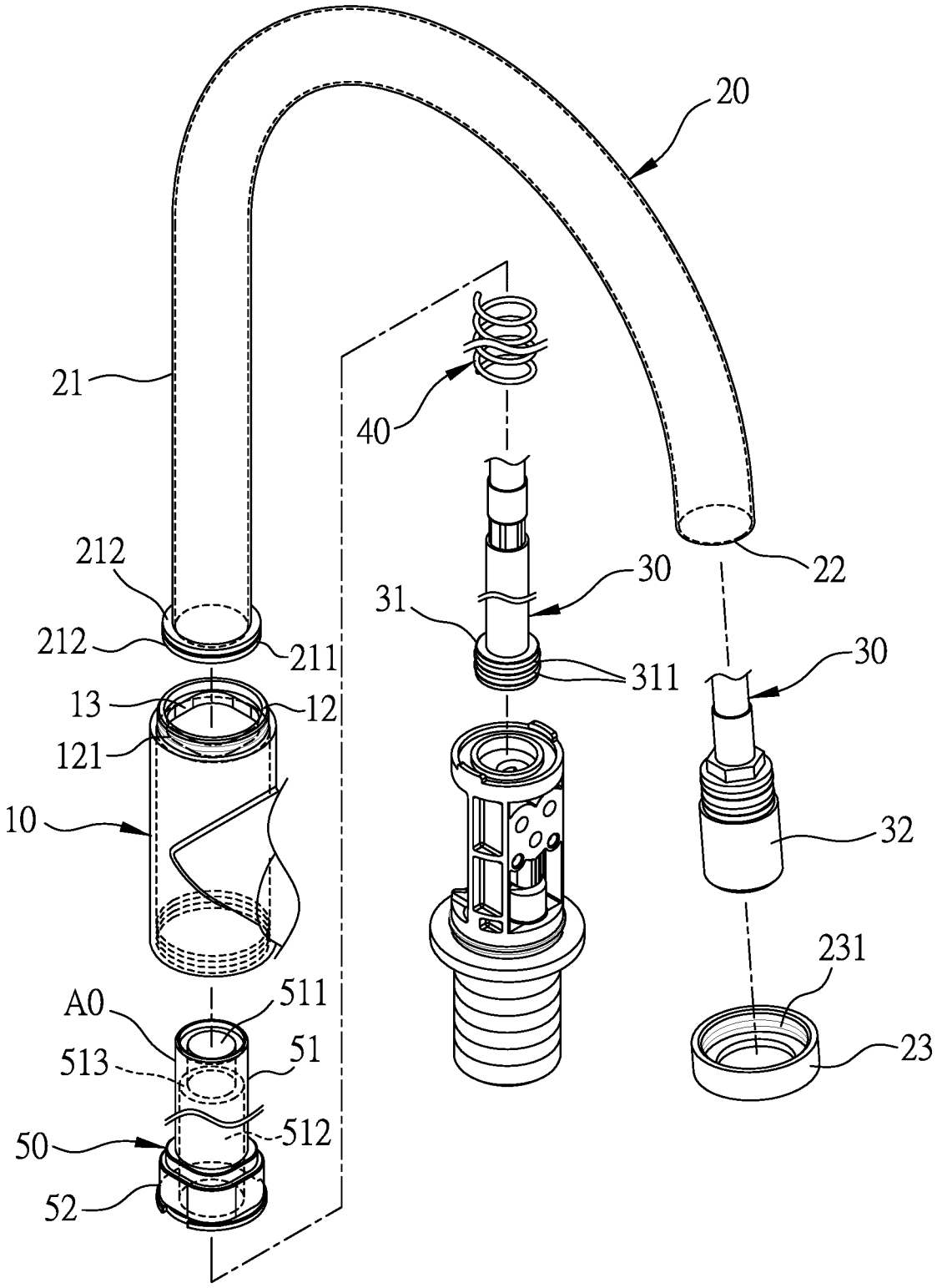
FIG. 2 is a perspective view showing the exploded components of the retractable hose structure of the pull-out faucet according to the preferred embodiment of the present invention.
Figure 3:
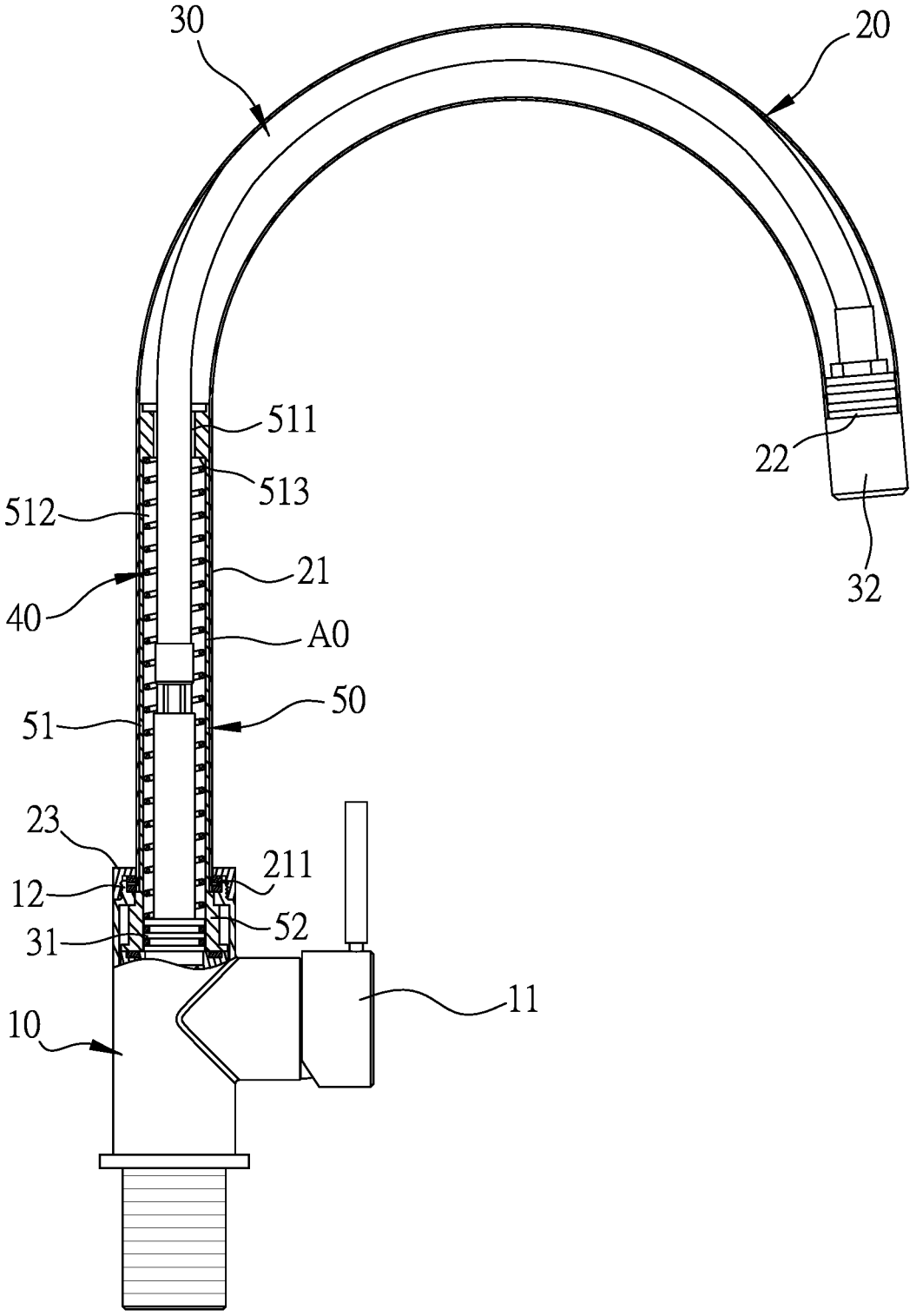
FIG. 3 is a cross-sectional view showing the assembly of the retractable hose structure of the pull-out faucet according to the preferred embodiment of the present invention.
Figure 4:
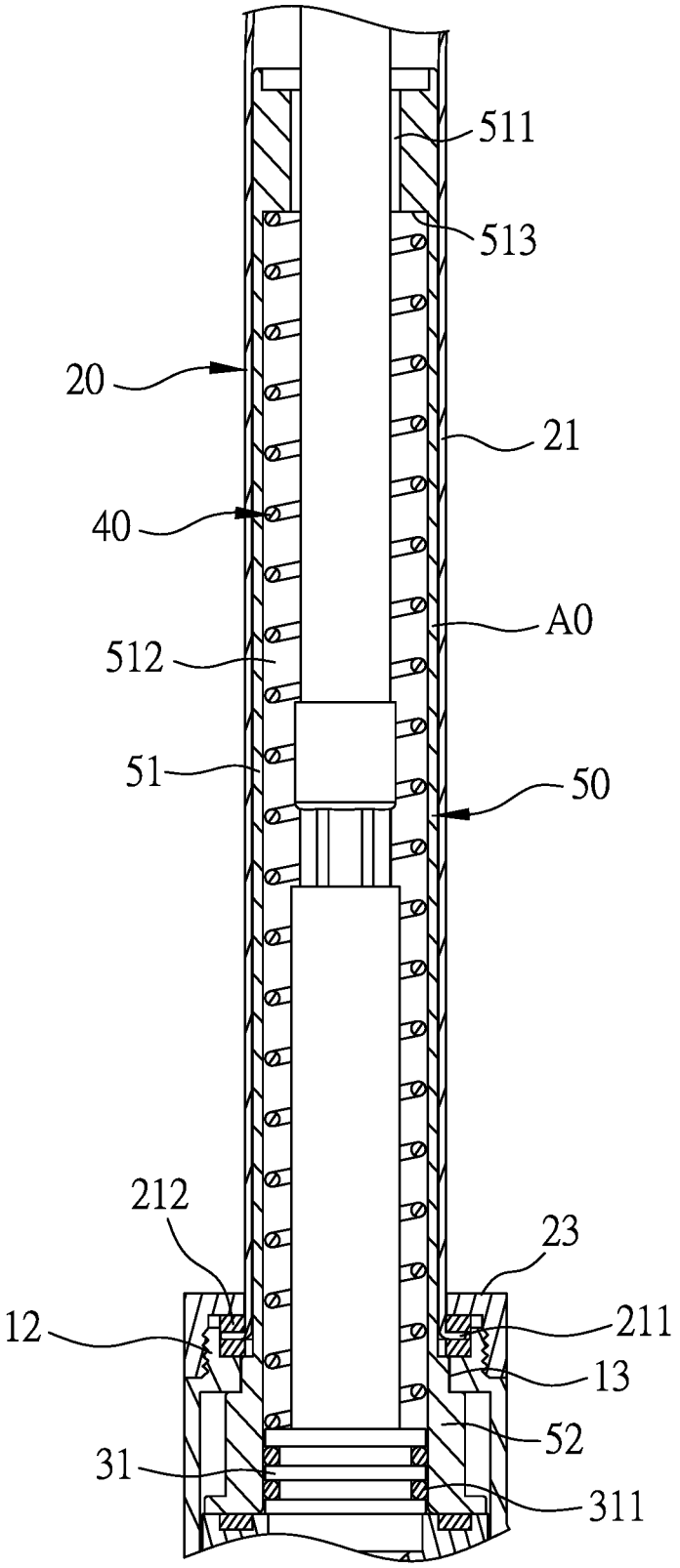
FIG. 4 is an amplified cross-sectional view of a part of FIG. 3.

The present invention will be clearer from the following description when viewed together with the accompanying drawings, which show, for purpose of illustrations only, a preferred embodiment in accordance with the present invention.

With reference to FIGS. 1-4, a retractable hose structure of a pull-out faucet according to a preferred embodiment of the present invention comprises: a body 10, a supply pipe 20, a flexible hose 30, a spring 40, and a connection member 50.

The body 10 includes a control portion 11 configured to control water supply and mounted on a side of the body 10, a locking portion 12 formed on a top of the body 10, and a connecting portion 13 arranged on an inner wall of the top of the body 10, wherein the locking portion 12 has outer threads 121 formed on an outer wall thereof.

The supply pipe 20 is hollow, and the supply pipe 20 includes an extension 21 formed on a first end thereof, an opening 22 defined on a second end of the supply pipe 20, a defining portion 211 formed on a bottom of the extension 21, a screw element 23 locked on an outer wall of the defining portion 211, the defining portion 211 being circularly protruded, and two first seal rings 212 fitted on an upper end and a lower end of the defining portion 211 respectively, and the screw element 23 has inner threads 231 defined on an inner wall thereof, such that the defining portion 211 is screwed with the outer threads 121 of the locking portion 12 of the body 10 by using the inner threads 231 of the screw element 23, the supply pipe 20 is connected with the body 10, and the two first seal rings 212 of the defining portion 211 stop a water leakage.

The flexible hose 30 is slidably received in the supply pipe 20, and the flexible hose 30 includes a slide portion 31 formed on a first end thereof, wherein the slide portion 31 has at least one second seal ring 311 fitted thereon (in this embodiment, two second seal rings 311 are fitted on the slide portion 31), the flexible hose 30 further includes a water supply head 32 fixed on a second end of the flexible hose 30 and located outside of the supply pipe 20, wherein the water supply head 32 is locked with the opening 23 of the supply pipe 20 and is pulled outward with the flexible hose 30 based on using requirements.

The spring 40 is accommodated in the supply pipe 20 and is fitted on an outer wall of the flexible hose 30, wherein at least one non-metallic insulation layer A0 is defined between the spring 40 and the supply pipe 20 so as to stop the spring 40 contacting with the supply pipe 20 directly, thus avoiding fraction between the spring 40 and the supply pipe 20 and noises. When pulling the water supply head 32 outward with the flexible hose 30, the spring 40 is actuated by the flexible hose 30 to retract. When releasing the water supply head 32, the spring 40 drives the water supply head 32 to move back to an original position with the flexible hose 30.

The connection member 50 includes a hollow fixing column 51 formed therein and a fitting portion 52 fitted on a bottom of the fixing column 51, wherein the fixing column 51 is fitted on an inner wall of the extension 21 on the supply pipe 20 (in this embodiment, the fixing column 51 is the non-metallic insulation layer A0), the fitting portion 52 is fitted with the connecting portion 13 of the body 10, and the fixing column 51 has a through hole 511 defined adjacent to an upper end thereof, a receiving orifice 512 formed below the through hole 511 and communicating with the fitting portion 52, and a shoulder 513 defined between the receiving orifice 512 and the through hole 511, wherein the through hole 511 and the receiving orifice 512 are configured to accommodate the flexible hose 30, such that the slide portion 31 of the flexible hose 30 is slidably fitted in the receiving orifice 512 of the fixing column 51, the spring 40 is accommodated in the receiving orifice 512 of the fixing column 51, a first end of the spring 40 abuts against the shoulder 513 of the fixing column 51, and a second end of the spring 40 contacts with the slide portion 31 of the flexible portion 30.

Figure 5:
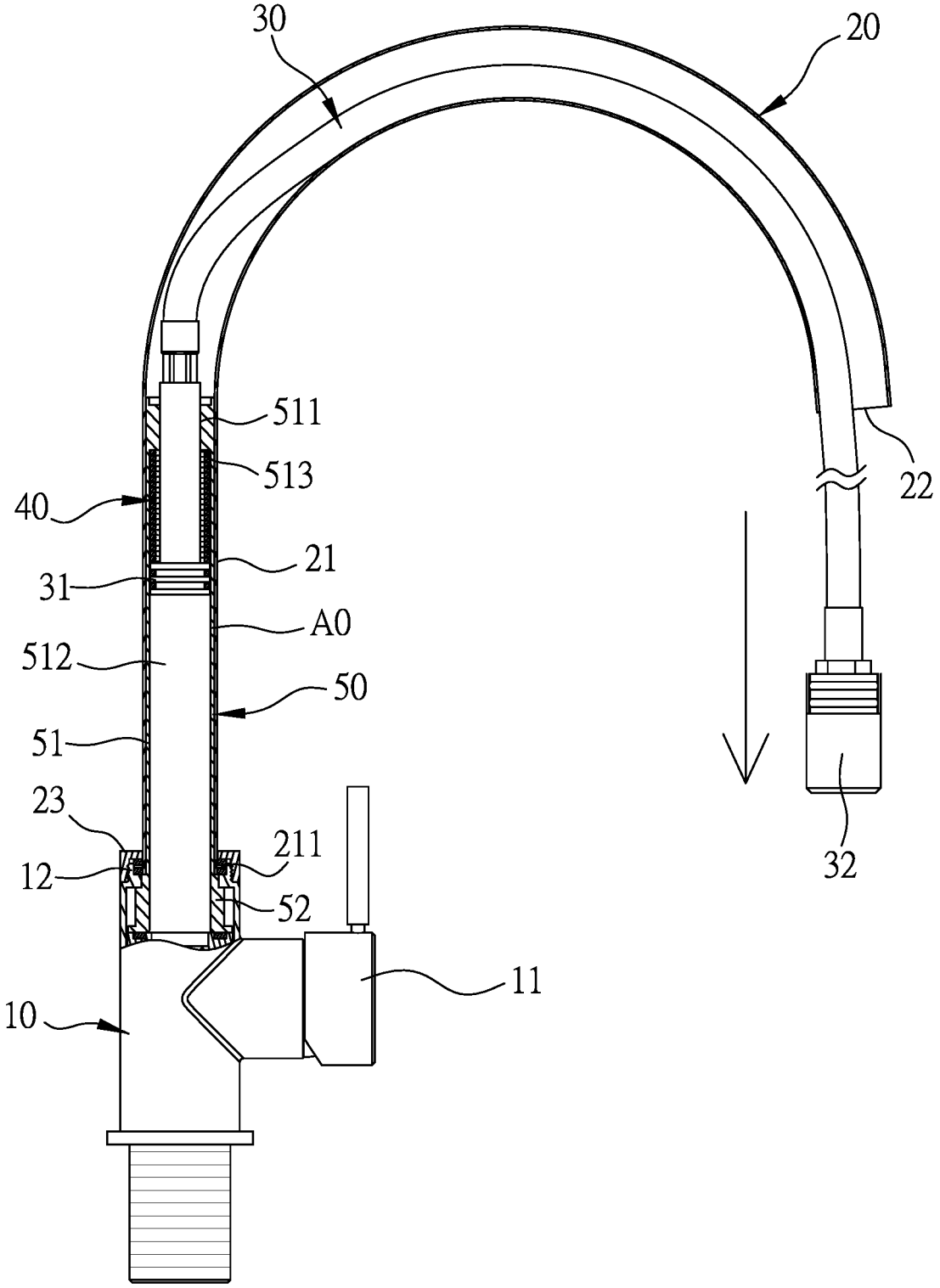
FIG. 5 is a cross-sectional view showing the operation of the retractable hose structure of the pull-out faucet according to the preferred embodiment of the present invention.
Figure 6:
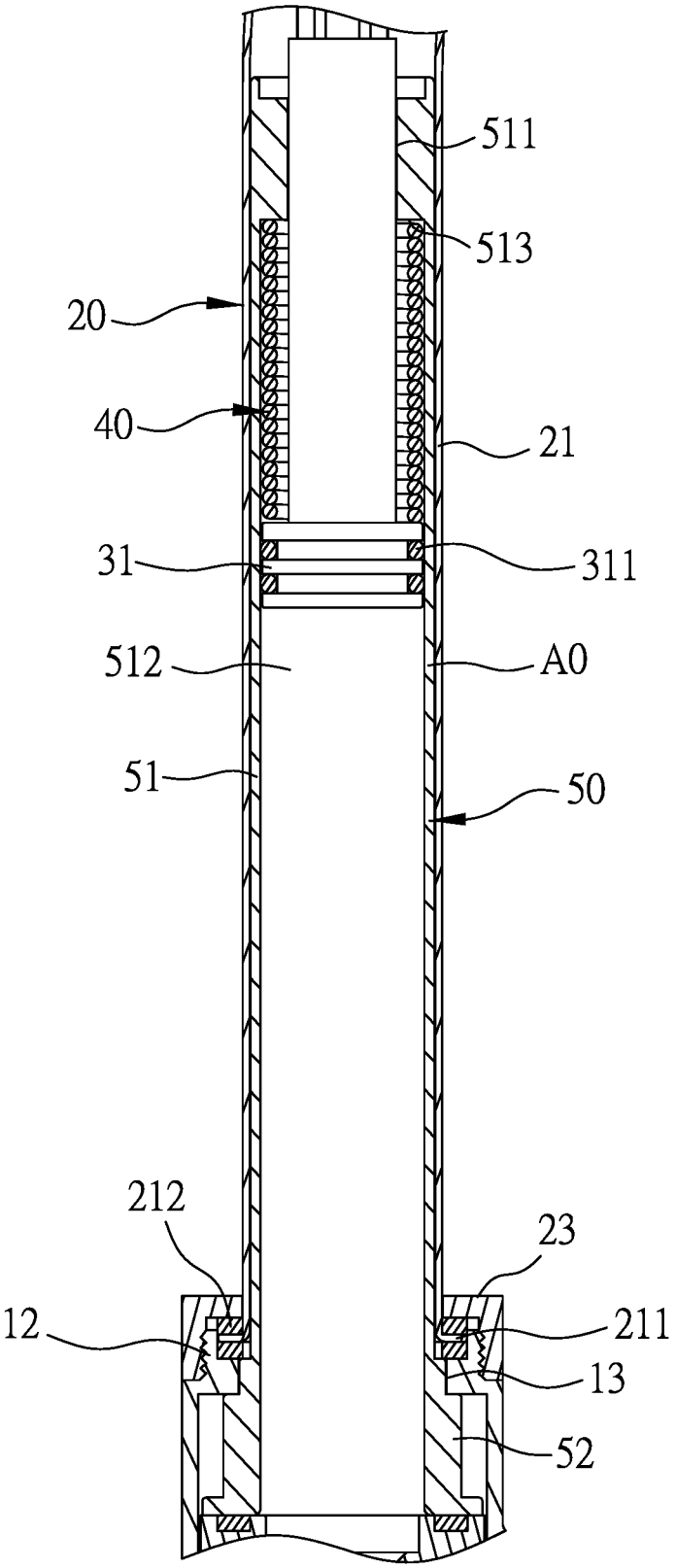
FIG. 6 is an amplified cross-sectional view of a part of FIG. 5.

In operation, the control portion 11 is configured to control water flow mixed with cold water and hot water at a predetermined proportion so that the water flow passes through the body 10 and the flexible hose 30 to flow out of the water supply head 32. When washing a countertop or other objects with a large size, as shown in FIGS. 5-6, the water supply head 32 is pulled outward to a desired position with the flexible hose 30, in the meantime, the slide portion 31 of the flexible hose 30 moves close to the shoulder 513 of the connection member 50 so as to actuate the spring 40, and after releasing the water supply head 32, the slide portion 31 of the flexible hose 30 moves to the shoulder 513 of the connection member 50 so as to accurate the spring 40 to retract, and the spring 40 drives the water supply head 32 to move back to the original position with the flexible hose 30, after releasing the water supply head 32.

The at least one non-metallic insulation layer A0 defined between the spring 40 and the supply pipe 20 is the fixing column 51 of the connection member 50. Alternatively, the fixing column 51 is eliminated from the connection member 50, and the at least one non-metallic insulation layer A0 is arranged on the spring 40 or/and the inner wall of the extension 21 of the supply pipe 20, wherein the at least one non-metallic insulation layer A0 is made of plastic or rubber so as to separate the spring 40 from the extension 21 of the supply pipe 20, thus stopping the spring 40 contacting with the supply pipe 20 to cause the metallic fraction and make the noises. Thereby, the retractable hose structure of the pull-out faucet of the present invention contains:

1. The flexible hose 30 and the spring 40 are accommodated in the supply pipe 20 so as to reduce a size of the body 10 and obtain easy fabrication.

2. The flexible hose 30 does not pass through the body 10 so as to connect a faucet, achieve easy maintenance, and decrease installation failure rate.

While various embodiments in accordance with the present invention have been shown and described, it is clear to those skilled in the art that further embodiments may be made without departing from the scope of the present invention.

What is claimed is:

1. A retractable hose structure of a pull-out faucet comprising:

a body including a locking portion formed on a top of the body;

a supply pipe being hollow, and the supply pipe including a defining portion formed on a first end of the supply pipe, an opening defined on a second end of the supply pipe, and a screw element locked on an outer wall of the defining portion, wherein the defining portion is screwed with the locking portion of the body by the screw element;

a flexible hose slidably received in the supply pipe, and the flexible hose including a slide portion formed on a first end of the flexible hose, a water supply head fixed on a second end of the flexible hose and located outside of the supply pipe, wherein the water supply head is locked with the opening of the supply pipe and is pulled outward with the flexible hose based on using requirements; and a spring accommodated in the supply pipe and fitted on an outer wall of the flexible hose, wherein at least one non-metallic insulation layer is defined between the spring and the supply pipe so as to stop the spring contacting with the supply pipe directly, wherein when pulling the water supply head outward, the spring is actuated by the flexible hose to retract; when releasing the water supply head, the spring drives the water supply head to move back to an original position, and further comprising:

a connection member, wherein the body includes a connecting portion arranged on an inner wall of the top thereof, an extension formed on a first end of the supply pipe, the defining portion formed on a bottom of the extension, wherein the connection member includes a hollow fixing column formed therein and is the at least one non-metallic insulation layer, a fitting portion fitted on a bottom of the fixing column, wherein the fixing column is fitted on an inner wall of the extension on the supply pipe, the fitting portion is fitted with the connecting portion of the body, and the fixing column has a through hole defined adjacent to an upper end thereof, a receiving orifice formed below the through hole and communicating with the fitting portion, and a shoulder defined between the receiving orifice and the through hole, wherein the through hole and the receiving orifice are configured to accommodate the flexible hose, such that the slide portion of the flexible hose is slidably fitted in the receiving orifice of the fixing column, the spring is accommodated in the receiving orifice of the fixing column, a first end of the spring abuts against the shoulder of the fixing column, and a second end of the spring contacts with the slide portion of the flexible portion.

2. The retractable hose structure as claimed in claim 1, wherein the locking portion of the body has outer threads, the screw element has inner threads, such that the inner threads of the screw element are screwed with the outer threads of the locking portion of the body, thus connecting the supply pipe with the body.

3. The retractable hose structure as claimed in claim 1, wherein the defining portion of the supply pipe is circularly protruded, and two first seal rings are fitted on an upper end and a lower end of the defining portion respectively so as to stop a water leakage.

4. The retractable hose structure as claimed in claim 1, wherein the slide portion of the flexible hose has at least one second seal ring fitted thereon.

5. The retractable hose structure as claimed in claim 1, wherein the at least one non-metallic insulation layer is arranged on an inner wall of the extension of the supply pipe.

6. The retractable hose structure as claimed in claim 5, wherein the at least one non-metallic insulation layer is made of plastic or rubber.

7. A retractable hose structure of a pull-out faucet comprising:

a body including a locking portion formed on a top of the body;

a supply pipe being hollow, and the supply pipe including a defining portion formed on a first end of the supply pipe, an opening defined on a second end of the supply pipe, and a screw element locked on an outer wall of the defining portion, wherein the defining portion is screwed with the locking portion of the body by the screw element;

a flexible hose slidably received in the supply pipe, and the flexible hose including a slide portion formed on a first end of the flexible hose, a water supply head fixed on a second end of the flexible hose and located outside of the supply pipe, wherein the water supply head is locked with the opening of the supply pipe and is pulled outward with the flexible hose based on using requirements; and a spring accommodated in the supply pipe and fitted on an outer wall of the flexible hose, wherein at least one non-metallic insulation layer is defined between the spring and the supply pipe so as to stop the spring contacting with the supply pipe directly, wherein when pulling the water supply head outward, the spring is actuated by the flexible hose to retract; when releasing the water supply head, the spring drives the water supply head to move back to an original position, and wherein the at least one non-metallic insulation layer is arranged on the spring.

8. The retractable hose structure as claimed in claim 7, wherein the at least one non-metallic insulation layer is made of plastic or rubber.

9. A retractable hose structure of a pull-out faucet comprising:

a body including a locking portion formed on a top of the body;

a supply pipe being hollow, and the supply pipe including a defining portion formed on a first end of the supply pipe, an opening defined on a second end of the supply pipe, and a screw element locked on an outer wall of the defining portion, wherein the defining portion is screwed with the locking portion of the body by the screw element;

a flexible hose slidably received in the supply pipe, and the flexible hose including a slide portion formed on a first end of the flexible hose, a water supply head fixed on a second end of the flexible hose and located outside of the supply pipe, wherein the water supply head is locked with the opening of the supply pipe and is pulled outward with the flexible hose based on using requirements; and a spring accommodated in the supply pipe and fitted on an outer wall of the flexible hose, wherein at least one non-metallic insulation layer is defined between the spring and the supply pipe so as to stop the spring contacting with the supply pipe directly, wherein when pulling the water supply head outward, the spring is actuated by the flexible hose to retract; when releasing the water supply head, the spring drives the water supply head to move back to an original position, and wherein the at least one non-metallic insulation layer is arranged on the spring and an inner wall of an extension of the supply pipe.

10. The retractable hose structure as claimed in claim 9, wherein the at least one non-metallic insulation layer is made of plastic or rubber.

* * * * *